United States Patent [19]

Yoshizawa

[11] 4,271,617

[45] Jun. 9, 1981

[54] METHOD OF REMOVING SNOW FROM GROUND SURFACE

[76] Inventor: Daisuke Yoshizawa, 449 Sakuradani, Tottori-shi, Japan

[21] Appl. No.: 59,616

[22] Filed: Jul. 23, 1979

Related U.S. Application Data

[63] Continuation-in-part of Ser. No. 921,608, Jul. 3, 1978, abandoned.

[30] Foreign Application Priority Data

Dec. 28, 1978 [JP] Japan ..... 53-162827

[51] Int. Cl.[3] ..... E01H 5/10; B05B 9/02

[52] U.S. Cl. ..... 37/195; 37/12; 239/287

[58] Field of Search ..... 37/12, 195; 239/146, 239/164, 168, 169, 170, 172, 175, 176, 287; 134/172, 198, 5, 16, 24

[56] References Cited

U.S. PATENT DOCUMENTS

| | | | |
|---|---|---|---|
| 3,404,470 | 10/1968 | Raiti | 37/12 |
| 3,456,368 | 7/1969 | Jacques | 37/12 |
| 3,709,436 | 1/1973 | Foster | 239/287 |
| 3,814,320 | 6/1974 | Skurray | 239/169 X |
| 3,987,964 | 10/1976 | Pittman et al. | 239/287 X |

*Primary Examiner*—E. H. Eickholt

*Attorney, Agent, or Firm*—Birch, Stewart, Kolasch & Birch

[57] ABSTRACT

A method of removing snow from ground surfaces, comprising discharging into a layer of snow lying on the ground in front of a travelling vehicle, high velocity water from a plurality of nozzles mounted on the front portion of the vehicle extending horizontally across the width of the vehicle, in a forward and downward direction at a pressure of not less than 40 kg./cm$^2$ and at a rate of at least 30 liters/min.

2 Claims, 5 Drawing Figures

METHOD OF REMOVING SNOW FROM GROUND SURFACE

BACKGROUND AND SUMMARY OF THE INVENTION

This invention is a continuation-in-part of my copending application Ser. No. 921,608, filed July 3, 1978 now abandoned.

This invention relates to a method of removing snow from the ground surface, and more particularly to the method of removing a layer of snow lying on the ground in front of a travelling vehicle by discharging high velocity water into the layer of snow.

In the removal of fallen snow from streets, roadways or the like in the wintertime, the most traditional technique is to utilize power-driven snowplows or scrapers which move the snow off into piles or rows which later must be picked up by loaders or the like and transported to an available dumping area. This procedure is time and labour consuming since it requires separate operations.

A technique which does not involve the above-mentioned separate operations in order to remove the snow has been proposed, for example, in U.S. Pat. No. 3,456,368. In this technique, a motor vehicle is provided which has hot water sprays attached to a front bumper and which converts the snow to water and slush. A water and slush pick-up unit including a scraper and an impeller is mounted underneath the vehicle behind the sprays and transfers the water and slush to a reservoir mounted on the motor vehicle. The water from the reservoir is heated and fed to the sprays so that the vehicle can operate independently of a water supply. Various similar techniques which utilize a motor vehicle equipped with a snow pick-up means and a snow melting means are also disclosed in U.S. Pat. Nos. 3,304,632, 3,309,798, 3,464,128, 3,353,286, 3,803,732, and 3,866,340.

A further technique which utilizes a stream of gasses propelled at high velocity by the exhaust blast of a turbo-jet engine is disclosed in U.S. Pat. No. 3,041,748.

However, all of the above referred to conventional techniques utilizing a snow pick-up means and a snow melting means require a high operating cost because of their complex operational system and because of fuel consumption. The technique utilizing a turbo-jet engine also requires a high operating cost because it requires an expensive apparatus for producing high velocity gasses.

Accordingly, it is an object of the present invention to provide a simple method of removing snow from paved surfaces of streets, roadways or the like without utilizing snow pick-up means and snow melting means.

Another object of the invention is to provide a method of removing snow from the paved surfaces at a relatively low cost with unskilled labor.

Other objects, features and advantages of the present invention will become apparent from the detailed description given hereinafter in connection with the accompanying drawings which are given by way of illustration only, and thus are not limitative of the present invention.

DESCRIPTION OF THE PREFERRED EMBODIMENTS

Figure 1:
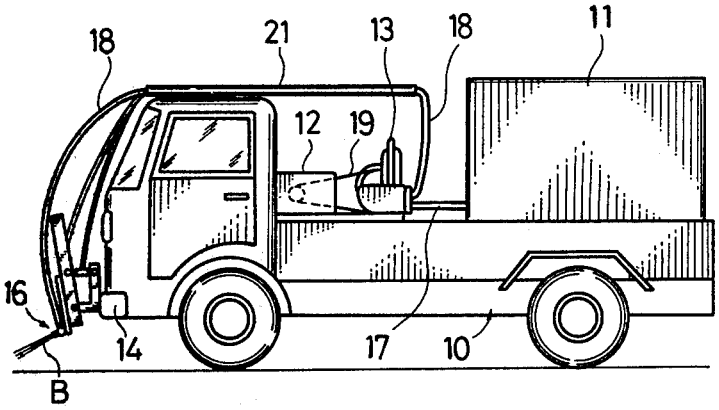
FIG. 1 is a side elevation of a vehicle provided with a water tank, a prime mover, a high pressure pump to be actuated by the prime mover, and a high pressure nozzle unit for carrying out the method according to the present invention.

As shown in FIG. 1, the snow removing method of the present invention utilizes a vehicle 10 provided with a water tank 11, a prime mover 12, a high pressure pump 13 to be actuated by the prime mover 12, and a high pressure nozzle unit 16 providing a line of a plurality of nozzles 15 (FIGS. 2 and 4) mounted horizontally along the lower front of the vehicle 10. The water stored in the tank 11 is fed through a pipe 17 to the high pressure pump 13 which supplies the pressurized water to the unit 16 through a pressure hose 18. The driving power of the prime mover 12 is transmitted through a belt 19 to the high pressure pump 13. The pressure hose 18 is a flexible tube connecting the pump 13 to a nozzle header 20 (FIGS. 2, 4 and 5) of the unit 16. The flexible hose 18 is partly supported by a rigid tubular element 21 extending over the top of the driving cab of the vehicle. The flexible hose 18 may be replaced by a rigid metallic pipe, if desired. In this case, however, it must be able to adjust to each position and angle of the line of nozzles 15.

The vehicle 10 is a conventional truck in FIG. 1 but it may be replaced by other suitable vehicles such as motor cars, electric motor vehicles or diesel engined vehicles.

The water tank 11 is filled with water preferably containing an anti-freeze agent in order to enhance the snow-thawing effect produced by the water as well as to prevent the injection nozzles 15 and the hose 18 from being frozen when the vehicle is standing idle. The water tank 11 should be large enough to enable snow removal to take place with the minimum of interruptions for refilling the tank. Otherwise, a separate water carrier may be towed behind to replenish the tank 11 as it is used up.

The pumping power of the high pressure pump must be sufficient to enable the thickness of snow to be dealt with, that is to be melted by the kinetic energy of the water forced out under high pressure from the nozzles 15.

To melt fresh snow 30 cm deep which has not yet frozen into ice, a pump of 25 PS capacity which is designed to develop 75 $Kg/cm^2$ maximum pressure and to deliver approximately 125 liter/min maximum of water through the apparatus illustrated is utilized. In practice, the pressure required to melt fresh snow 30 cm deep has been found to be in the range of 50 $Kg/cm^2$ to 60 $Kg/cm^2$, with a water flow of about 100 liter/min. To melt fresh snow 20 cm deep, the water flow may be decreased to 40 liter/min, with the pressure unchanged. To melt fresh snow less than 15 cm deep, the water flow may be further decreased to about 30 liter/min, and the pressure may also be decreased to about 40 $Kg/cm^2$.

If the snow is 20 cm deep and has not yet frozen but has been stamped down by treads of vehicle tyres, about 70 $Kg/cm^2$ to 80 $Kg/cm^2$ water pressure is required with a maximum water rate of 150 liter/min. It is necessary to employ a pump providing a slightly higher pressure to satisfy these conditions.

Figure 2:
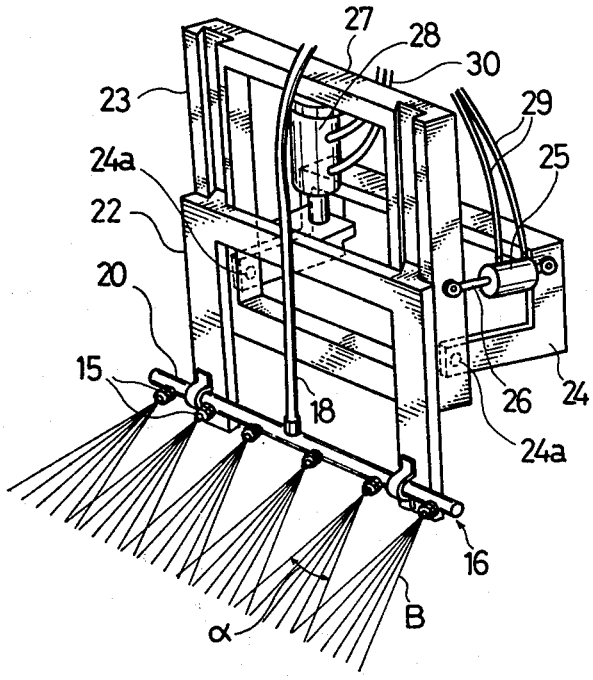
FIG. 2 is an enlarged perspective view showing a line of frame-mounted nozzles.
Figure 4:
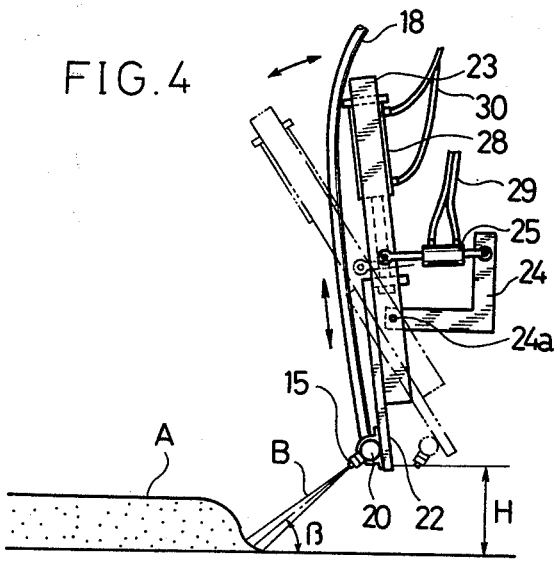
FIG. 4 is a side elevation showing how the line of nozzles operate.

The nozzle unit 16 illustrated in FIGS. 2 and 4 has the header 20 equipped with six nozzles 15 and mounted on a support frame 22. A guide bracket 23 carries the frame 22 in vertically slidable manner thereon, and a mounting attachment 24 hinged to the bracket 23 by supporting pins 24a enables the angle of inclination of the bracket 23 and frame 22 to be altered. Between the attachment 24 and the bracket 23 is fitted at least one hydraulic cylinder 25 having a piston 26, so that the bracket 23 may be adjusted in inclination to a desired angle as shown in FIG. 4 in broken outline. The frame 22 is mounted on a slideway on the bracket 23 and is vertically controllable thereon by a second adjuster also formed by a hydraulic cylinder 28 which is fixedly mounted on an upper lateral member 27 of the guide bracket 23. It is convenient to utilize the high pressure water available from the pump 13 (FIG. 1) in order to actuate the adjuster cylinders 25, 28. For that purpose, hoses 29, 30 are employed to connect the cylinders 25, 28 with the pump 13.

Figure 3:
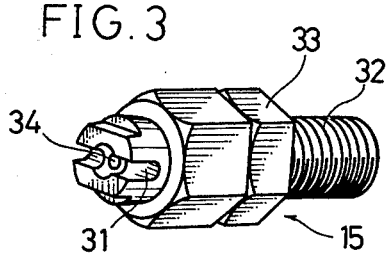
FIG. 3 is an enlarged perspective view of a single nozzle.

The nozzles 15 are disposed in a forward and downward inclination in relation to the header 20. Each of the nozzles 15 provides a flat fantail jet by having its orifice 34 opening into the back of a slit 31 as particularly shown in FIG. 3. Preferably, the divergency angle $\alpha$ of the jet from the nozzle 15 is set at 30° to 80°. Each of the nozzles 15 has a threaded tubular shank 32 screwed to the header 20 and a locknut 33 engageable with the shank 32, so that the most appropriate nozzles 15 for handling the depth and nature of the snow to be cleared can be selected for fitting to the header 20. Since the nozzles 15 are to be used with very high pressure water, the basic parts of them are preferably made of an anti-abrasion material such as sintered hard alloys or ceramics having good wearing properties.

To carry out the method of the invention, the nozzle unit 16 is adjusted as shown in FIG. 4, so that the orifices 34 of the nozzles are correctly positioned to provide the optimum water pattern formed by the fantail streams of water B jetted out of the nozzles 15 into the snow A on the ground. The optimum pattern is of stripe shape substantially equal to or slightly wider than the width of the vehicle 10. Further, the discharge angle $\beta$ of water B to the vertical is preferably set in the range of 20° to 30°, with each nozzle 15 placed in the lowermost position possible in order to maximize the kinetic energy of the water striking the snow. The height H (FIG. 4) of each nozzle 15 from the ground surface G (FIG. 5) should, under normal circumstances, be adjustable within the range of 10 cm to 50 cm. During snow removing operations, the water is jetted out of the nozzles 15 as long as the vehicle is advancing.

Experiments have proved that with a high pressure pump 13 operating at 60 Kg/cm$^2$ and delivering 100 liter/min of water to the six nozzles which are at a height of 40 cm and produce jets at an angle of 30°, the vehicle 10 can be driven at a speed of 20 Km/h. When snow is removed in the manner as described above, neither snow ploughs nor any other scraper or blade means are utilized, so that there is no fear of damage to the road surface during operation.

Figure 5:
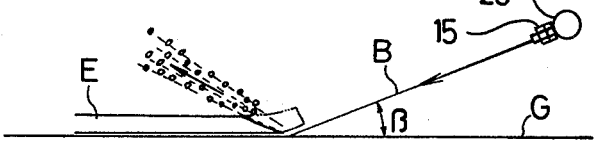
FIG. 5 is a schematic side elevation showing how to remove frozen snow from the ground surface.

The method of the invention can also be applied to remove snow frozen in the form of ice plate. In this case, the pressure of the water should be increased to about 150 Kg/cm$^2$ at the nozzles, with a flow rate of 250 liter/min. For this purpose, it is necessary to employ a high pressure pump 13 having sufficient capacity to develop the pressure and flow rates referred to. The running speed ratio of the vehicle 10 in this case should be decreased to about 7 Km/h to 8 Km/h. Further in this case, the water B is unable to melt the ice plate almost instantaneously as is the case with the fresh snow. Such ice plate forms usually during the nighttime. By aiming the water B between the ice plate E and the ground G as shown in FIG. 5, the ice plate is violently thrown up from the ground surface G or stripped therefrom enabling it to be subsequently broken up into pieces. The hydraulic cylinder 25 is operated to determine the optimum angle $\beta$ of the streams of water B which will usually lie in the range of 45° to 60° to produce initial breaking of portions of the ice plate E away from the ground. Thereafter the hydraulic cylinder 25 may be operated to change the angle $\beta$ to the range 20° to 30° and the vehicle driven again over the ice to cause the water B to penetrate between the ice plate E and the ground G and force the remaining ice plate away from the road surface. Especially in urban districts where traffic volume is rather heavy, the broken pieces of the ice plate E on the ground are quickly broken up further, by the wheels of vehicles, into small pieces which are quickly melted by increase in atmospheric temperature such as occurs after sunrise.

The vehicle 10 may have its front portion provided with a suitable covering for protecting it from water jetted against the snow, so that the windshield of the vehicle 10 is not splashed with spray and slush. Preferably, the vehicle 10 also has an upper portion of the windshield provided with a mirror (not shown) to enable a driver to see how effective the jetted water B is and whether adjustment of either of the angles $\alpha$ or $\beta$ is necessary.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

I claim:

1. A method of removing a layer of snow frozen into a form of an ice plate and lying on the ground in front of a travelling vehicle, comprising initially breaking up a part of said ice plate by discharging into said ice plate high velocity water from a plurality of nozzles mounted on and extending horizontally across the front width portion of the vehicle, in a forwards and downwards direction at an angle in a range of 45° to 60° with respect to a surface of the ground and at a pressure of not less than 140 Kg/cm$^2$, and then varying said angle to a range of 20° to 30°, while continuing to discharge said water into a gap between said ice plate and said ground surface to strip said ice plate from said surface of the ground.

2. The process as disclosed in claim 1, wherein said water contains an anti-freeze agent.

* * * * *

UNITED STATES PATENT AND TRADEMARK OFFICE

CERTIFICATE OF CORRECTION

PATENT NO. : 4,271,617

DATED : June 9, 1981

INVENTOR(S) : Yoshizawa

It is certified that error appears in the above—identified patent and that said Letters Patent is hereby corrected as shown below:

On the Title Page "[30] Foreign Application Priority Data", before "Dec. 28, 1978 [JP] Japan ..... 53-162827" insert --Jul. 4, 1977 [JP] Japan ..... 52-80209--.

Signed and Sealed this

*First* Day of *December 1981*

[SEAL]

*Attest:*

GERALD J. MOSSINGHOFF

*Attesting Officer*

*Commissioner of Patents and Trademarks*